US011490672B2

(12) United States Patent
Curbeon

(10) Patent No.: US 11,490,672 B2
(45) Date of Patent: Nov. 8, 2022

(54) PRE-BRAIDED HAIR EXTENSION

(71) Applicant: Daisy Curbeon, New York, NY (US)

(72) Inventor: Daisy Curbeon, New York, NY (US)

(73) Assignee: Daisy Curbeon, Bronx, NY (US)

( * ) Notice: Subject to any disclaimer, the term of this patent is extended or adjusted under 35 U.S.C. 154(b) by 60 days.

(21) Appl. No.: 16/211,906

(22) Filed: Dec. 6, 2018

(65) Prior Publication Data

US 2020/0178629 A1 Jun. 11, 2020

(51) Int. Cl.
*A41G 5/00* (2006.01)

(52) U.S. Cl.
CPC ..... *A41G 5/006* (2013.01); *A41G 5/0046* (2013.01)

(58) Field of Classification Search
CPC .... A41G 5/0006; A41G 5/004; A41G 5/0046; A41G 5/006; A41G 5/0053; A41G 5/00; A41G 5/0073; A41G 5/008; A41G 5/0086
See application file for complete search history.

(56) References Cited

U.S. PATENT DOCUMENTS 5,497,795 A * 3/1996 Hibbard ..... A45D 8/34 132/200
5,758,670 A * 6/1998 Ogunro ..... A45D 2/00 87/8
5,890,498 A * 4/1999 Kawaguchi ..... A45D 8/24 132/275
2004/0163660 A1* 8/2004 Kellmann ..... A41G 5/0073 132/201
2008/0163882 A1* 7/2008 Owens ..... A41G 5/006 132/201
2013/0312781 A1* 11/2013 Murphy ..... A41G 5/0073 132/201
2016/0227864 A1* 8/2016 Mosser ..... A41G 5/004
2017/0215505 A1* 8/2017 Shin ..... A41G 5/0046
2017/0251739 A1* 9/2017 Kim ..... A41G 3/0075
2020/0054086 A1* 2/2020 Mayer ..... A41G 5/0046

FOREIGN PATENT DOCUMENTS

JP 2007-16365 * 1/2007

* cited by examiner

*Primary Examiner* — Cris L. Rodriguez
*Assistant Examiner* — Brianne E Kalach
(74) *Attorney, Agent, or Firm* — Quinn IP Law

(57) ABSTRACT

A pre-braided hair extension is configured to be attached to a bunched grouping of hair of a wearer and includes a plurality of hairs weaved into a braided pattern. The hair extension further includes a first end comprising a decorative end of the pre-braided hair extension and a second end distal from the first end, wherein the second end is configured to receive the bunched grouping of hair there through. According to one embodiment, the second end can include a loop. The loop can be configured to receive the bunched grouping of hair there through. The hair ropes weaved into the braided pattern can be configured to permit threading of the bunched grouping through and among the hair ropes.

7 Claims, 11 Drawing Sheets

PRE-BRAIDED HAIR EXTENSION

TECHNICAL FIELD

This disclosure is related to a product utilized in hair styling. In particular, embodiments of the disclosure are directed to the field of supplemental hair fabricated from natural human hair or synthetic hair.

BACKGROUND

The statements in this section merely provide background information related to the present disclosure. Accordingly, such statements are not intended to constitute an admission of prior art.

Pre-braided hair extensions are known in the art, in one exemplary configuration, including a band that worn around the head of the user like a headband and with braided hair extending downward from the band. The band that wraps around the head can be an rubber band. The band that wraps around the head can be a decorative headband. The band that wraps around the head can be braided hair. In any of these embodiments, the band wrapping around the head gives away to even a casual viewer that the braids hanging down from the band are not the natural hair of the wearer.

In another embodiment, a headband including a C-shaped flexible plastic piece, configured to stretch over the top of the head of the wearer, can include braids hanging down from the plastic piece. The plastic piece can be colored or wrapped with braided hair to attempt to hide the presence of the headband; however, the headband still gives away even to a casual viewer that the braids hanging down from the headband are not the natural hair of the wearer.

Known hair extensions can be attached to the scalp of the wearer and can include semi-permanent attachment methods that can harm the wearer's scalp or hair. The wearer can be forced to wear the hair extensions for up to three months. In particular, where the hair extensions include artificial hair, the artificial or plastic hair can degrade through normal use and washing cycles and become brittle and weak. Human hair used in hair extensions, when worn for long periods of time, can become messy and unkempt.

SUMMARY

A pre-braided hair extension is configured to be attached to a bunched grouping of hair of a wearer and includes a plurality of hairs weaved into a braided pattern. The hair extension further includes a first end comprising a decorative end of the pre-braided hair extension and a second end distal from the first end, wherein the second end is configured to receive the bunched grouping of hair there through. According to one embodiment, the second end can include a loop. The loop can be configured to receive the bunched grouping of hair there through. The hair ropes weaved into the braided pattern can be configured to permit threading of the bunched grouping through and among the hair ropes.

According to one embodiment for use with short hair of the wearer, the second end including the loop is used to pull a grouping of the short hair through the pre-braid. The grouping of the wearer's hair can be bunched with a small rubber band. A loop of the hair extension or a thin thread or cord attached to the hair extension is wrapped around a base of the hair of the user between the rubber and the scalp of the wearer. Any remaining portion of the wearer's hair can then be pulled and threaded through the braid pattern of the hair extension. For extended use of the hair extensions, it will be appreciated that new hair growth can simply be pulled further through the rubber and the braids of the hair extension.

BRIEF DESCRIPTION OF THE DRAWINGS

One or more embodiments will now be described, by way of example, with reference to the accompanying drawings, in which.

DETAILED DESCRIPTION

Figure 4:
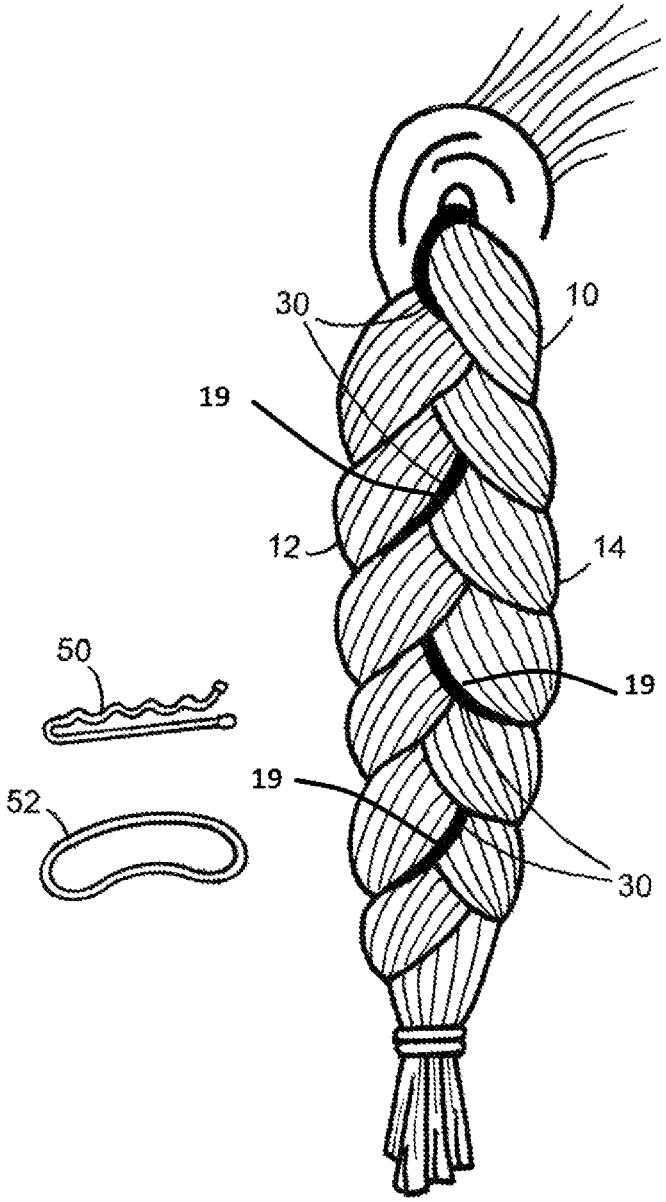
FIG. 4 illustrates the pre-braided hair extension of FIG. 3, with the bunched grouping of hair being threaded between and among the hair ropes of the pre-braided hair extension, in accordance with the present disclosure.

A pre-braided hair extension including braids that attach to the hair of the wearer are disclosed. The pre-braided hair extension includes a decorative end which is permitted to hang down from the head of the wearer. The pre-braided hair extension includes an attachment end distal from the decorative end. The pre-braided hair extension includes a braided hair pattern between the attachment end and the decorative end, the braided hair pattern including two or more twisted hair ropes braided into an alternating pattern. In one embodiment, the two hair ropes can be a single hair rope bent in the center and looped back upon itself. The attachment end includes a loop with a hole in the center of the loop configured to receive a bunched grouping of hair of the user. The braided hair pattern as illustrated in FIG. 4 further includes space 19 between the braided twisted hair ropes configured to receive an end of the bunched grouping of hair.

In some embodiments, such a pre-braided hair extension can simply wrap around the bunched grouping of hair of the wearer. In such an embodiment, an rubber band can be attached to the attachment end of the pre-braided hair extension, the bunched grouping of hair can be formed by tying or wrapping the bunched grouping together (in some instances, the bunched grouping can be simply a bunched together group of the wearer's hair without any wraps or ties), and the rubber band can be securingly wrapped around the bunched grouping.

However, one having skill in the art will appreciate that such an attachment at one point of the bunched grouping of hair, wrapping the rubber band around the bunched grouping at one point and hanging a somewhat heavy pre-braided hair extension from the bunched grouping at that one point, can create significant tension in the hair, causing damage to the hair or causing a significant number of the user's hairs to be pulled out of their follicles.

For extended use of the hair extensions, it will be appreciated that new hair growth can simply be pulled further through the rubber and the braids of the hair extension.

An improved process for attaching pre-braided hair extensions to bunched groupings of the wearer's hair is provided. The bunched grouping of hair can be threaded through the loop in the attachment end and then weaved into the braided hair ropes of the pre-braided hair extension, with the bunched grouping of hair looping between and around the hair ropes in their braided pattern. In this way, the stress of holding up the somewhat heavy pre-braided hair extension is distributed over the length of the bunched grouping of hair.

A pre-braided hair extension attaching to a bunched grouping of hair of the wearer looks more like natural hair than a hair extension wrapping around the head of the user. Further, by attaching to the bunched grouping of hair, problems with such a hair band damaging hair or the skin at the scalp of the wearer are avoided.

The disclosed pre-braided hair extensions can make use of natural or synthetic hair. Whereas previous methods of attaching and removing hair extensions could take ten hours or more, the disclosed device and methods can supplement a wearer's hair in mere minutes. The disclosed pre-braided hair extensions can be used for extended periods, for example, with new growth simply being pulled tight through the braids. The disclosed device attached to the hair without destroying or permanently damaging the hair strands of the wearer. The disclosed device can be constructed entirely with hypo-allergenic materials. The disclosed device does not need to be attached to the scalp of the wearer. Whereas previously known hair extensions required semi-permanent attachment to the head of the wearer, which caused the wearer to have to endure the discomfort of the semi-permanent attachment methods and also endure the wear and tear of such hair extensions over time, the ease of installing and removing the pre-braided hair extensions of the present disclosure alleviate the problems of the previously known devices.

Figure 1:
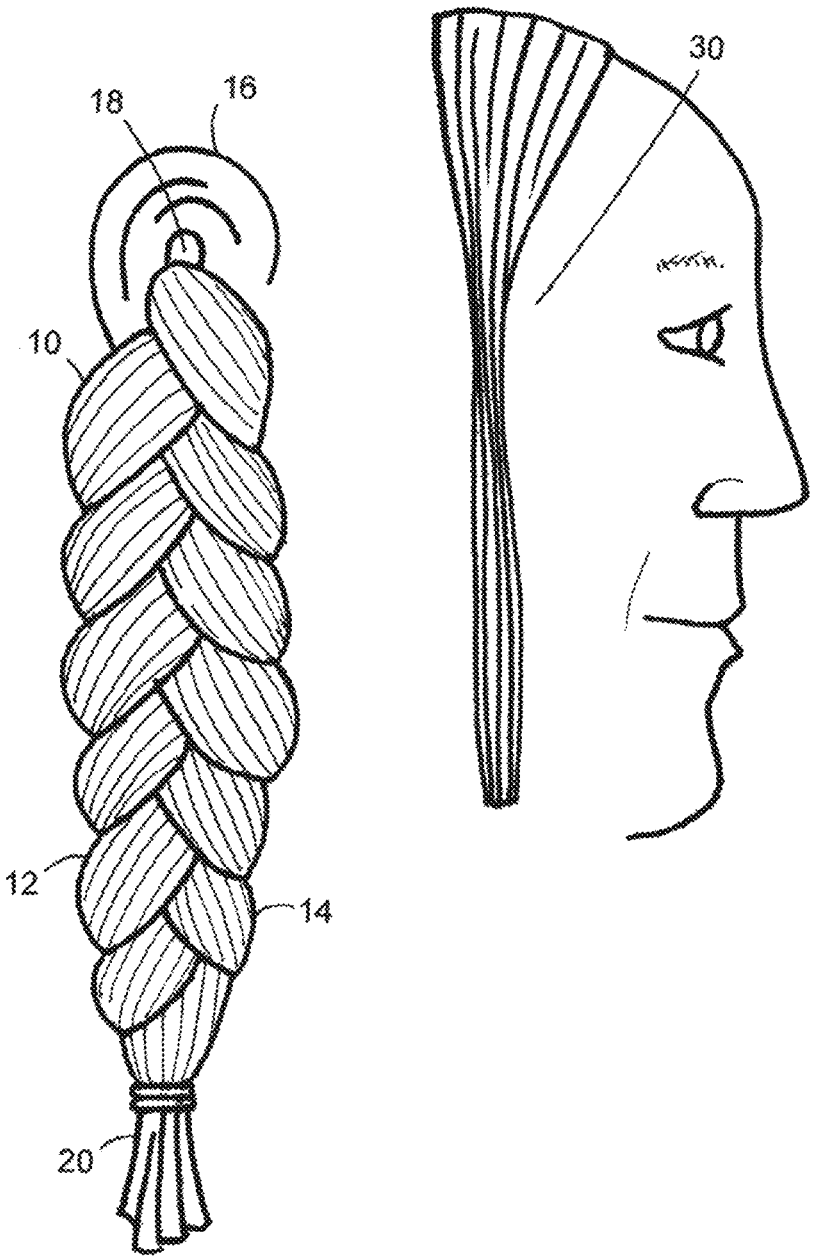
FIG. 1 illustrates an exemplary pre-braided hair extension for use with a bunched grouping of a wearer's hair, in accordance with the present disclosure.

Referring now to the drawings, wherein the showings are for the purpose of illustrating certain exemplary embodiments only and not for the purpose of limiting the same, FIG. 1 illustrates an exemplary pre-braided hair extension for use with a bunched grouping of a wearer's hair. Pre-braided hair extension 10 is illustrated including a plurality of hair ropes 12 and 14 in a braided pattern. Pre-braided hair extension 10 includes decorative end 20 and attachment end 16. Attachment end 16 includes loop 18. Pre-braided hair extension 10 is configured to attach to bunched grouping 30 of a wearer's hair.

Figure 2:
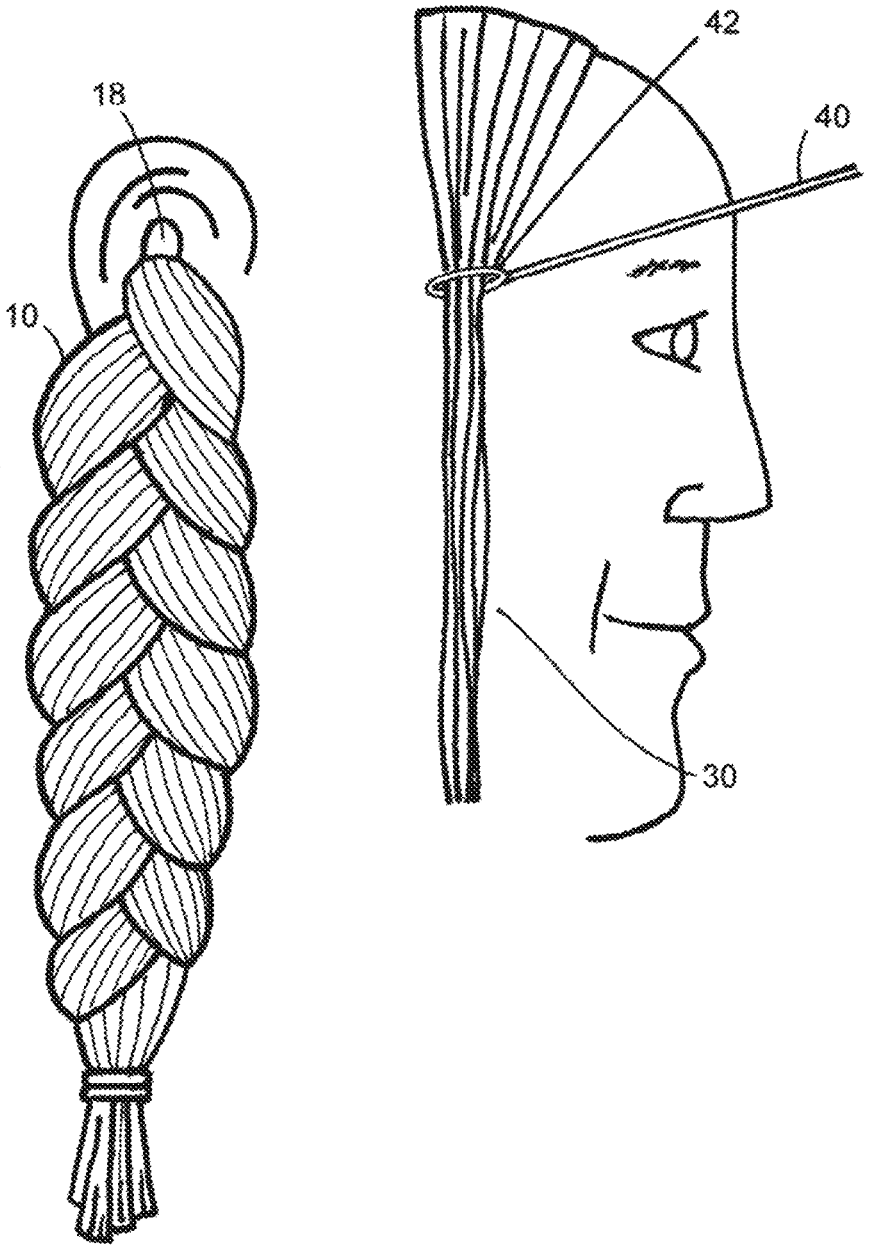
FIG. 2 illustrates the pre-braided hair extension of FIG. 1, with an exemplary hair needle capturing the bunched grouping of the wearer's hair, in accordance with the present disclosure.

FIG. 2 illustrates the pre-braided hair extension of FIG. 1, with an exemplary hair needle capturing the bunched grouping of the wearer's hair. Pre-braided hair extension 10 is illustrated including loop 18. Hair needle 40 includes end loop 42, which is illustrated engaged to bunched grouping 30 of a wearer's hair.

Figure 3:
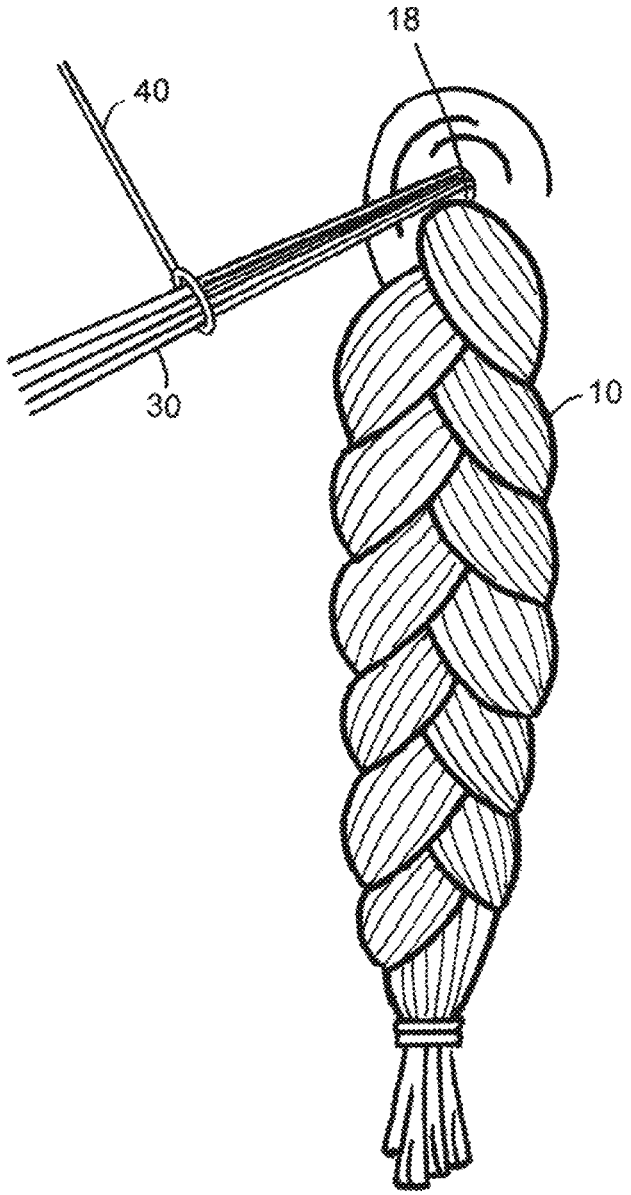
FIG. 3 illustrates the pre-braided hair extension of FIG. 2, with the bunched grouping of hair being pulled through the loop in the attachment end of the pre-braided hair extension, in accordance with the present disclosure.

FIG. 3 illustrates the pre-braided hair extension of FIG. 2, with the bunched grouping of hair being pulled through the loop in the attachment end of the pre-braided hair extension. Pre-braided hair extension 10 is illustrated including loop 18. Hair needle 40 is illustrated having pulled bunched grouping 30 through loop 18 of pre-braided hair extension 10.

FIG. 4 illustrates the pre-braided hair extension of FIG. 3, with the bunched grouping of hair being threaded between and among the hair ropes of the pre-braided hair extension. Pre-braided hair extension 10 is illustrated including bunched grouping 30 being threaded through and among hair ropes 12 and 14 of pre-braided hair extension 10. Optional hair pin 50 and rubberized band 52 are shown which can be used to help attach and secure bunched grouping 30 to pre-braided hair extension 10, although in some embodiments, the threading of bunched grouping 30 through hair ropes 12 and 14 can be sufficient to secure pre-braided hair extension 10 to bunched grouping 30. It will be appreciated that any number of known hair products can be used to bind, group, or fashion the hair of the user, such as but not limited to needles, hairpins, hair bands, etc.

In FIGS. 1-4, bunched grouping 30 is illustrated a darker color than the hairs of the pre-braided hair extension for purposes of clarity in the illustrations. It will be appreciated that the colors of hair of the bunched grouping and the pre-braided hair extension can be matched so that the pre-braided hair extension appears to be the natural hair of the wearer. In another embodiment, the hair the user can be threaded in and among the ropes of the pre-braided hair extension only on a back side of the hair extension or on a side that is proximate to the scalp or skin of the user, such that the hair of the user is not visible to an onlooker viewing the hair extension from the other side.

FIGS. 1-4 illustrate use of the disclosed pre-braided hair extensions with a user's hair that is long enough to be threaded in and among the ropes of the hair extensions. However, the disclosed pre-braided hair extensions can be used with shorter user hair, for example, by using a small rubber band or other intermediary fixing device to attach the hair extension to a short bunched grouping of the user's hair. In one exemplary embodiment, a lark's head knot known in the art can be used to fix a rubber band through the loop end of a hair extension, with a second distal end of the rubber band going through the loop to open and connect to the bunched grouping of user's hair.

Figure 5:
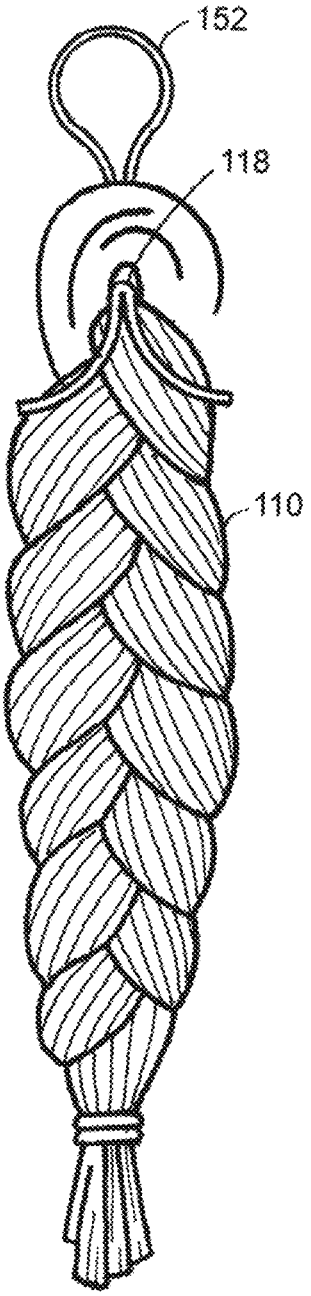
FIG. 5 illustrates an exemplary pre-braided hair extension including an rubber band threaded through and attached to a loop of the hair extension, in accordance with the present disclosure.

FIG. 5 illustrates an exemplary pre-braided hair extension including a rubber band threaded through and attached to a loop of the hair extension. Pre-braided hair extension 110 is illustrated including loop 118 and rubber band 152 threaded through loop 118. Rubber band 152 can be wrapped or otherwise attached to a bunched grouping of a user's hair. Rubber band 152 is exemplary, can be an elastic cord or an inelastic cord, and is particularly useful for connecting a pre-braided hair extension to particularly short hair of a user, for as short as ½ inch long hair or less.

It will be appreciated that a plurality of pre-braided hair extensions can be worn by a single wearer.

A number of different hair braiding techniques and styles are known in the hair styling arts. The included pre-braided hair extension can be modeled after any known hair braiding technique by modifying the illustrated pre-braided hair extension.

The pre-braided hair extension illustrated in FIGS. 1-4 is provided as an exemplary pre-braided hair extension. The braids are illustrated with one exemplary width of the braids, proportions of the braid widths to the overall length, and overall appearance of the hair extensions. It will be appreciated that the braids can be wider or narrower than the examples in the figures, the length of the hair extensions can change to be either longer or shorter than the illustrated hair extensions, and the number of bunches of hair and the particular weave pattern used to make the braids can be different than the illustrated examples in the figures.

Figure 6:
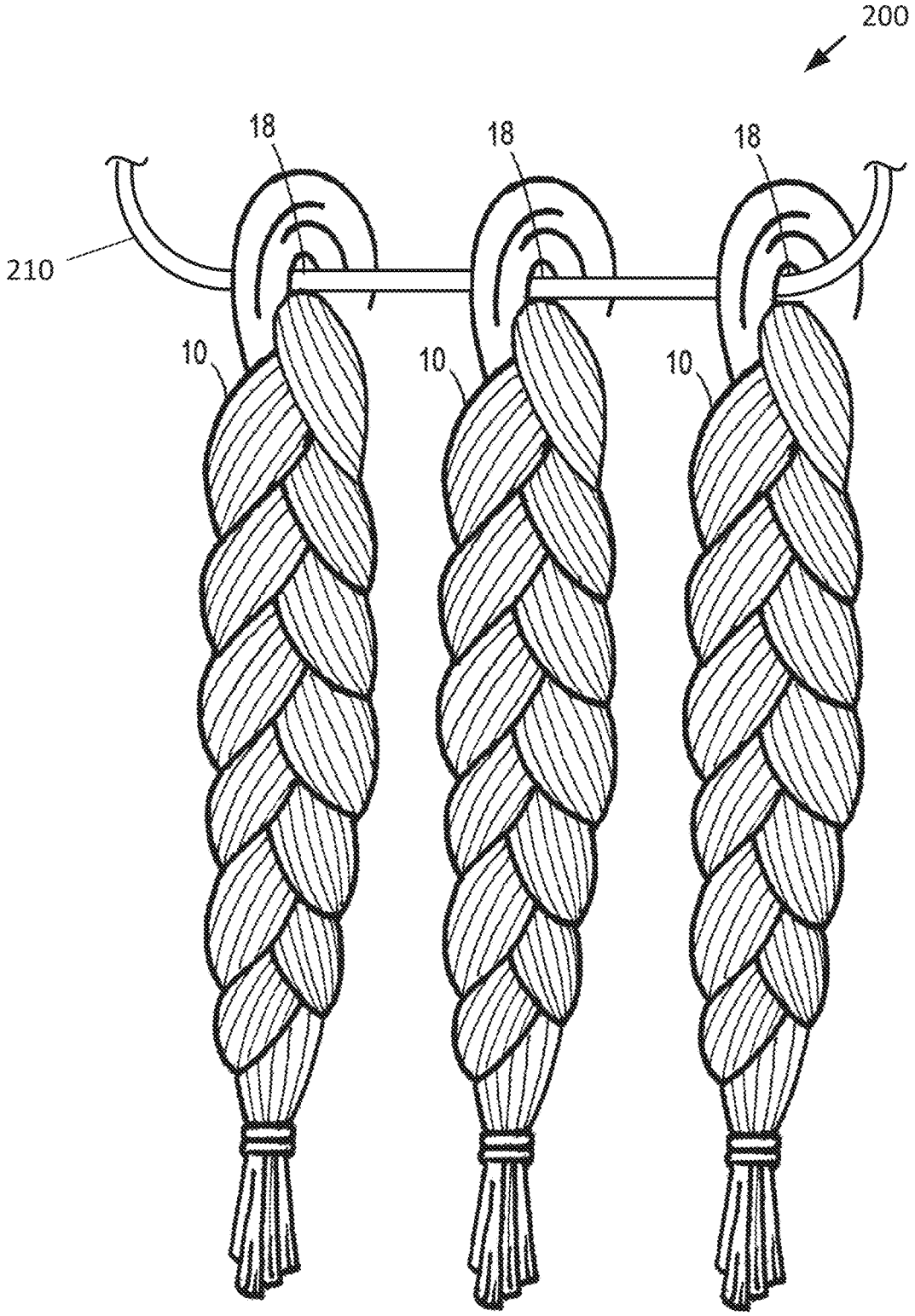
FIG. 6 illustrates an exemplary pre-braided hair extension assembly, providing a plurality of pre-braided hair extensions for attachment to the head of a user, in accordance with the present disclosure.

A number of pre-braided hair extensions can be used on a single user's head simultaneously. Each of those extensions can be separately attached to hair of the user. FIG. 6 illustrates an exemplary pre-braided hair extension assembly, providing a plurality of pre-braided hair extensions for attachment to the head of a user. Pre-braided hair extension assembly 200 is provided with a plurality of pre-braided hair extensions 10 being attached to an exemplary cord 210, which is threaded though loops 18 of each extension 10. Cord 210 can be attached to several bunched groupings of hair, can be tied or looped around the head of the wearer, or can be otherwise fastened to the head of the user. Cord 210 can be an inelastic cord. In another example, cord 210 can be an elongated elastic mesh rope, for example, with three longitudinal elastic bands tied together with periodic webbing threads, wherein the pattern formed by the elastic bands and the webbing enhance an ability of the cord to attach to the hair of the user.

Figure 7:
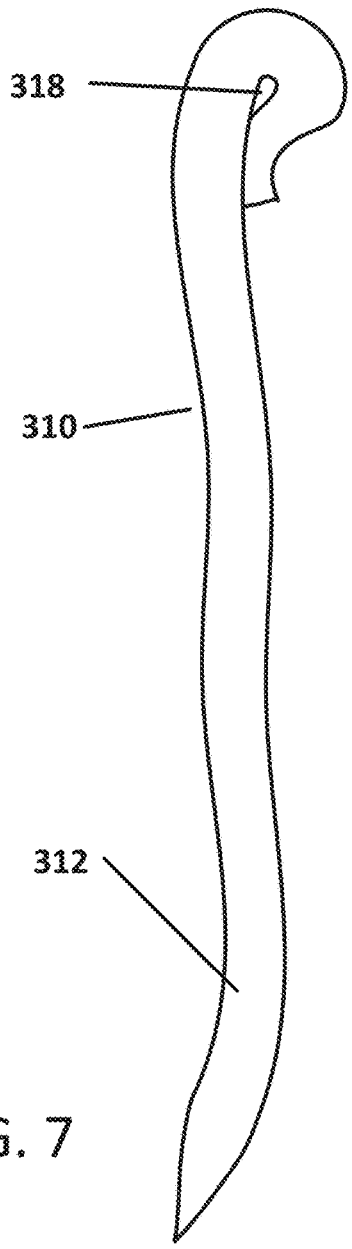
FIG. 7 illustrates an exemplary pre-braided hair extension assembly, providing an exemplary dreadlock hair extension for attachment to the head of a user with a single-ended dreadlock, in accordance with the present disclosure.

A number of different braid patterns can be used with the disclosed pre-braided hair extension assemblies. Exemplary braid patterns can include but are not limited to rat tails, fish tails, twin twisted strands twisted around each other, and dreadlocks. Dreadlocks are known in the art and include a matted pattern of hair. FIG. 7 illustrates an exemplary pre-braided hair extension assembly, providing an exemplary dreadlock hair extension for attachment to the head of a user with a single-ended dreadlock. Dreadlock hair extension 310 is illustrated including a first end formed into loop 318 for attachment to a wearer. Dreadlock hair extension 310 is illustrated further including a second end including a single-ended dreadlock 312.

Figure 8:
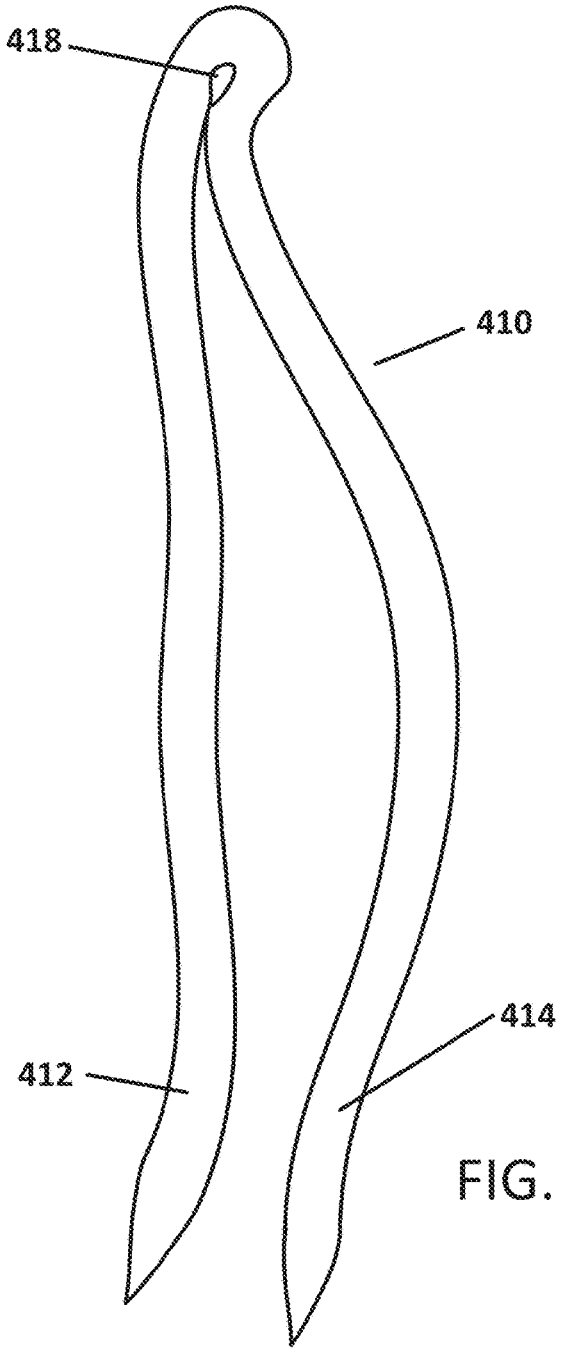
FIG. 8 illustrates an exemplary pre-braided hair extension assembly, providing an exemplary dreadlock hair extension for attachment to the head of a user with a double-ended dreadlock, in accordance with the present disclosure.

FIG. 8 illustrates an exemplary pre-braided hair extension assembly, providing an exemplary dreadlock hair extension for attachment to the head of a user with a double-ended dreadlock. Dreadlock hair extension 410 is illustrated including a first end formed into loop 418 for attachment to a wearer. Dreadlock hair extension 410 is illustrated further including a second end including a double-ended dreadlock including first dreadlock end 412 and second dreadlock end 414.

Figure 9:
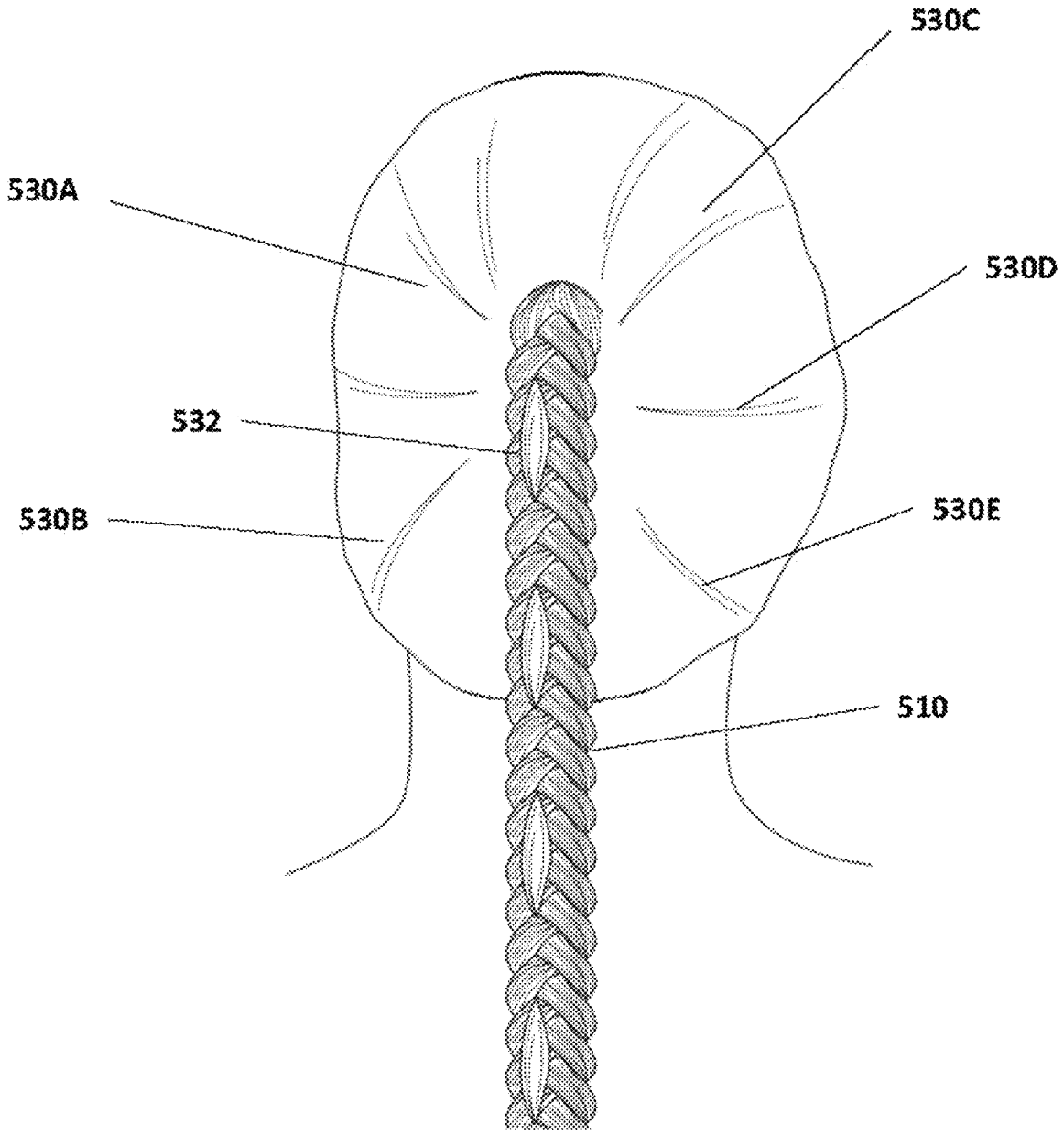
FIG. 9 illustrates an exemplary pre-braided hair extension with a plurality of bunched groupings of user's hair combined into a unified bunched grouping threaded into the pre-braided hair extension, in accordance with the present disclosure.

FIG. 9 illustrates an exemplary pre-braided hair extension with a plurality of bunched groupings of user's hair combined into a unified bunched grouping threaded into the pre-braided hair extension. Pre-braided hair extension 510 is illustrated including unified bunched grouping 532 of the user's hair which includes a combination of a plurality of bunched groupings 530A, 530B, 530C, 530D, and 530E of the user's hair. Unified bunched grouping 532 in one embodiment can be formed by combining bunched groupings and using a rubber band, pony tail band, or similar device to affix the hair into the unified bunched grouping 532. Unified bunched grouping 532 is threaded through pre-braided hair extension 510, with unified bunched grouping 532 being used to hold the pre-braided hair extension in place upon the head of the user.

Pre-braided hair extension 510 can but need not include a loop upon an upper or first end of the extension, as pre-braided hair extension 10 of FIG. 1 includes loop 18. In one embodiment, pre-braided hair extension 510 can include a tight pattern of braided hair ropes or other braided hair pattern all of the way up to an end of the hair extension, and unified bunched grouping 532 of the user's hair can simply be threaded through the pre-braided pattern of extension 510 without a specific loop being formed in the end of the extension, or, stated another way, a loop being useful to thread a user's hair through the hair extension can be formed by two or more of the hair ropes of a pre-braided pattern in the pre-braided hair extension without the loop being formed separate from the braided pattern.

Figure 10:
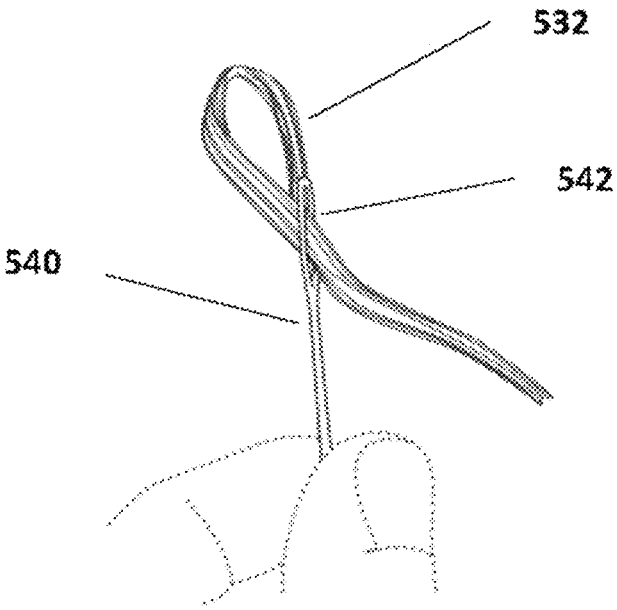
FIG. 10 illustrates a hair needle interacting with the unified bunched grouping of FIG. 9, in accordance with the present disclosure.
Figure 11:
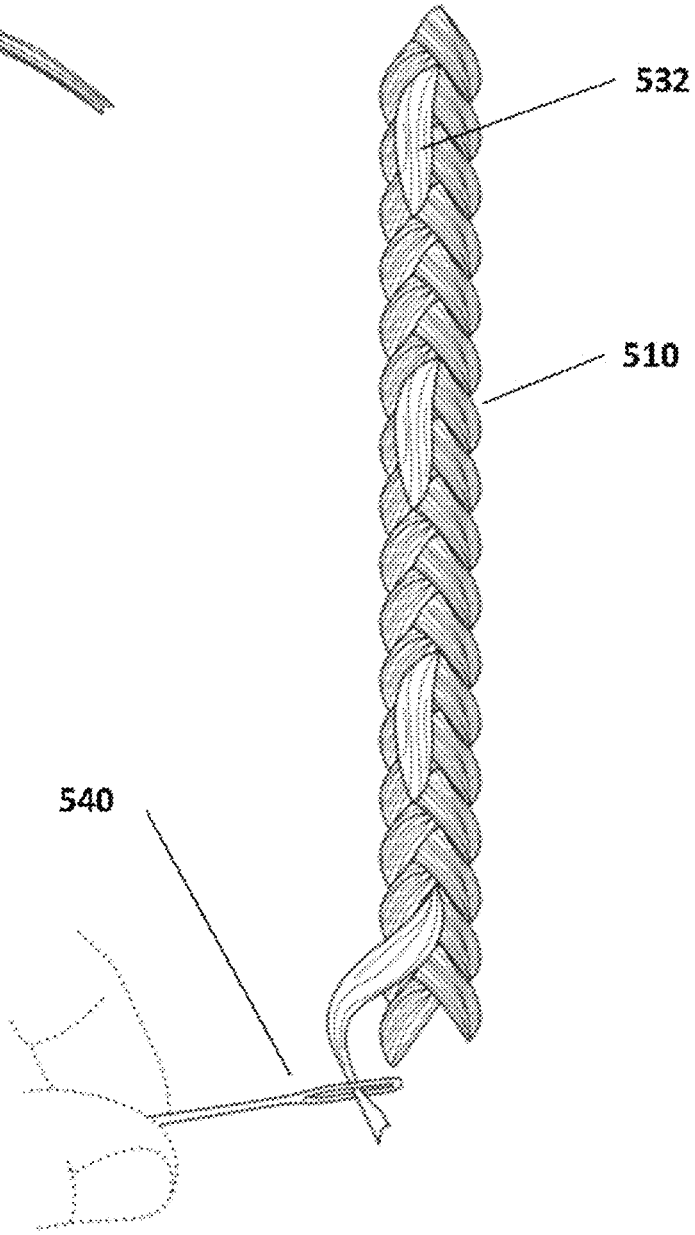
FIG. 11 illustrates the hair needle of FIG. 10 being used to thread the unified bunched grouping through the pre-braided hair extension of FIG. 9, in accordance with the present disclosure.

FIG. 10 illustrates a hair needle interacting with the unified bunched grouping of FIG. 9. Hair needle 540 is illustrated including eye 542 through which unified bunched grouping 532 of FIG. 9 is threaded. FIG. 11 illustrates the hair needle of FIG. 10 being used to thread the unified bunched grouping through the pre-braided hair extension of FIG. 9. Hair needle 540 is illustrated, with the user using hair needle 540 to thread unified bunched grouping 532 through the braided pattern of pre-braided hair extension 510.

Figure 12:
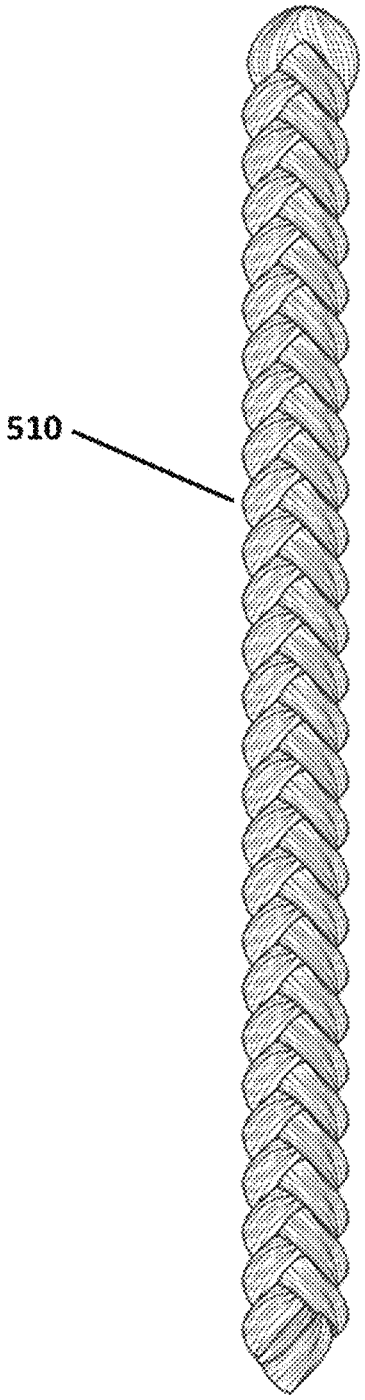
FIG. 12 illustrates the pre-braided hair extension of FIG. 9, in accordance with the present disclosure.
Figure 13:
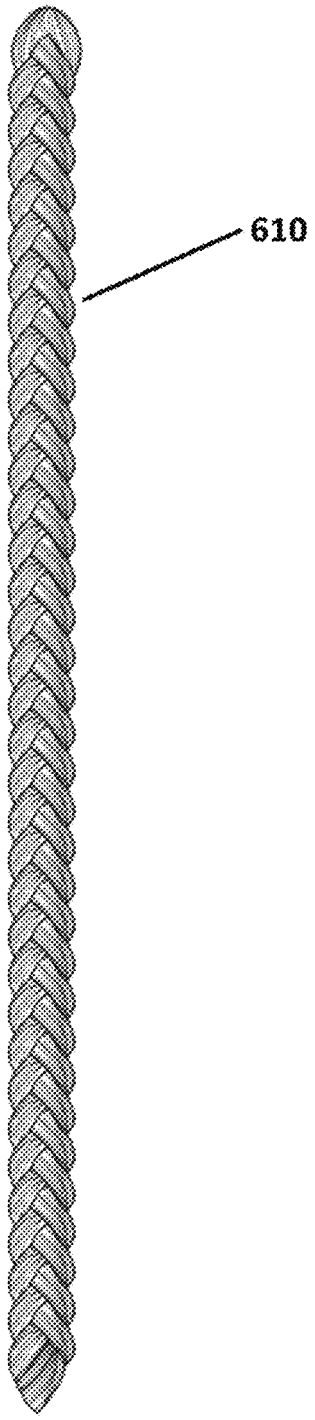
FIG. 13 illustrates an alternative exemplary pre-braided hair extension, in accordance with the present disclosure.

Pre-braided hair extensions can come in different lengths, widths, and braid configurations. FIG. 12 illustrates the pre-braided hair extension of FIG. 9. FIG. 13 illustrates an alternative exemplary pre-braided hair extension. Extension 510 of FIG. 12 is relatively wider than extension 610 of FIG. 13.

Figure 14:
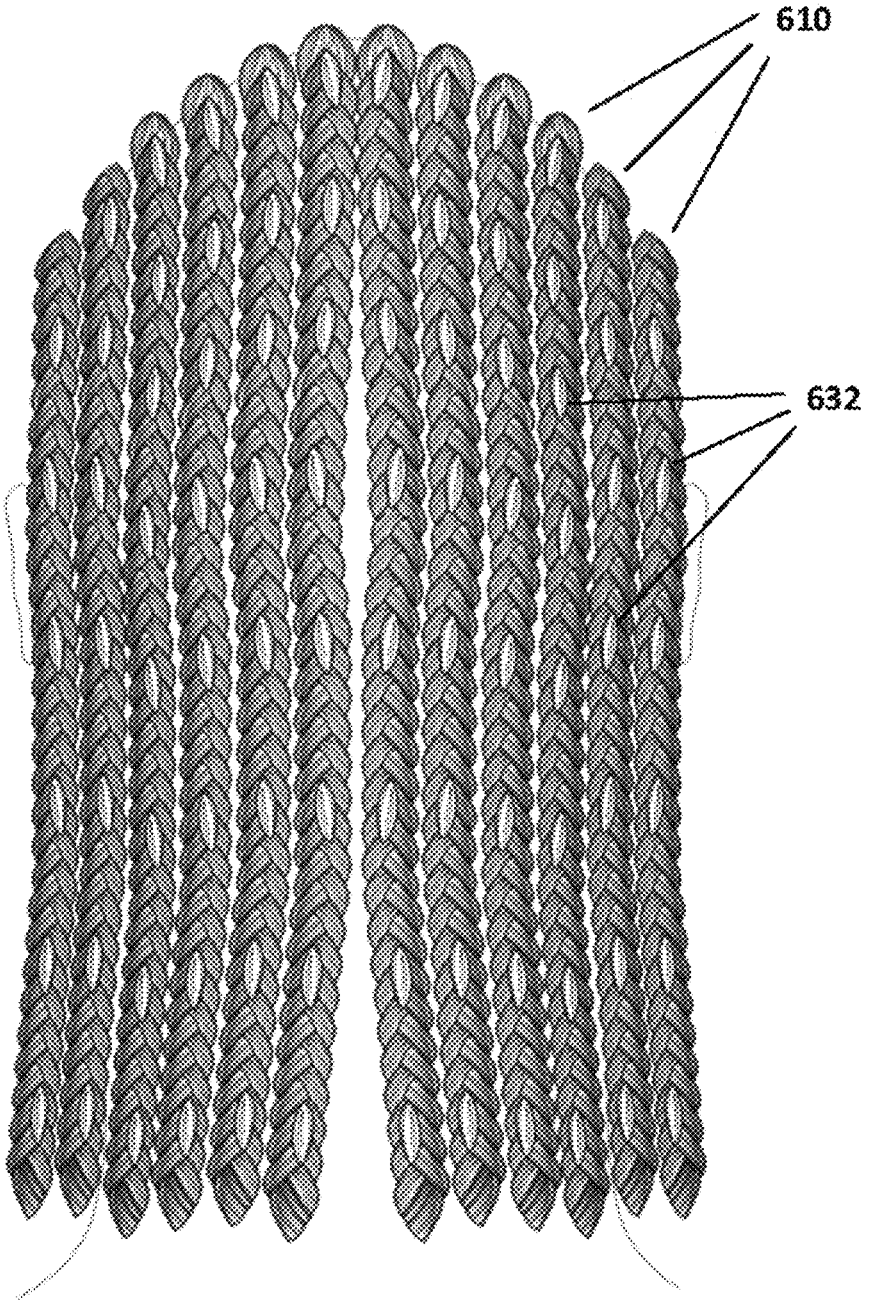
FIG. 14 illustrates a plurality of pre-braided hair extensions of FIG. 13 applied to the hair of a user, in accordance with the present disclosure.

FIG. 14 illustrates a plurality of pre-braided hair extensions of FIG. 13 applied to the hair of a user. A plurality of relatively thin pre-braided hair extensions 610 are illustrated, with each hair extension including a bunched grouping 632 of the user's hair being threaded into the braided pattern of each respective pre-braided hair extension 610.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A pre-braided hair extension, comprising:

a plurality of hair ropes weaved into a braided pattern along a length between a first end and a second end distal from the first end, wherein the braided pattern forms a plurality of spaces between the hair ropes along the length of the braided pattern and terminates in a loop formed by the hair ropes;

wherein the braided pattern is a pre-braided, existing pattern and is configured to receive a bunched grouping of a user's hair into the pre-braided, existing pattern by threading the bunched grouping of hair through the loop of the pre-braided hair extension and subsequently weaving the bunched grouping of hair through the plurality of spaces between the hair ropes along the length of the braided pattern.

2. The pre-braided hair extension of claim 1, further comprising a rubber band connected to the loop, wherein the rubber band is configured to be attached to the bunched grouping of hair.

3. The pre-braided hair extension of claim 1, further comprising a spring loaded clip connected to the loop, wherein the clip is configured to be attached to the bunched grouping of hair.

4. The pre-braided hair extension of claim 1, wherein the hair extension comprises a dreadlock.

5. The pre-braided hair extension of claim 4, wherein the first end comprises a single-ended dreadlock pattern.

6. The pre-braided hair extension of claim 4, wherein the first end comprises a double-ended dreadlock pattern.

7. A method of threading the bunched grouping of hair of the user through the pre-braided hair extension of claim 1, comprising:

threading the bunched grouping of hair through the loop in the hair ropes; and threading the bunched grouping of hair through the space between the hair ropes at a plurality of locations along the pre-braided hair extension.

* * * * *